United States Patent [19]

Kramer

[11] Patent Number: 4,533,804

[45] Date of Patent: Aug. 6, 1985

[54] PUSH BUTTON SLIDE SWITCH

[75] Inventor: Peter K. G. Kramer, Berlin, Fed. Rep. of Germany

[73] Assignee: ITT Industries, Inc., New York, N.Y.

[21] Appl. No.: 248,321

[22] Filed: Mar. 27, 1981

Related U.S. Application Data

[63] Continuation of Ser. No. 946,358, Sep. 27, 1978, abandoned.

[51] Int. Cl.[3] ..... H01H 13/52; H01H 3/12

[52] U.S. Cl. ..... 200/159 R; 200/340; 200/293

[58] Field of Search ..... 200/159 R, 153 J, 314, 200/325, 328, 340, 293, 296, 252, 260, 303, 16 R, 16 A, 16 B

[56] References Cited

U.S. PATENT DOCUMENTS

| | | | |
|---|---|---|---|
| 1,015,455 | 1/1912 | Neesham . | |
| 2,904,662 | 9/1959 | Spring | 200/314 |
| 3,274,354 | 9/1966 | Stevens | 200/314 |
| 3,415,966 | 12/1968 | Matthews | 200/252 |
| 3,582,592 | 6/1971 | Schadow | 200/159 R |
| 3,708,640 | 1/1973 | Fuller | 200/296 |
| 3,867,596 | 2/1975 | Schadow | 200/159 R |
| 3,868,486 | 2/1975 | Nakaya | 200/159 R |
| 4,087,669 | 5/1978 | Sauer | 200/293 |

FOREIGN PATENT DOCUMENTS

| | | | |
|---|---|---|---|
| 2019347 | 11/1971 | Fed. Rep. of Germany | 200/296 |
| 2347278 | 4/1974 | Fed. Rep. of Germany | 200/340 |

*Primary Examiner*—John W. Shepperd

*Attorney, Agent, or Firm*—James B. Raden; William J. Michals

[57] ABSTRACT

A push button slide switch, the slider of which is held within the housing by means of a tongue-like retaining member. The retaining member is shaped so that it can be moved upwards by means of a simple flat tool which is inserted below or above the wall of the housing carrying the retaining member. Thus, the slider can be easily removed from the switch housing even when the switch is mounted in a front panel.

5 Claims, 9 Drawing Figures

PUSH BUTTON SLIDE SWITCH

This is a continuation, of application Ser. No. 946,358 filed Sept. 27, 1978, now abandoned.

BACKGROUND OF THE INVENTION

The present invention relates to a push button slide switch in which fixed contacts are arranged in an elongated housing of insulated material, and in which a slider carrying movable contacts, is displaceably arranged, and in which, in a cutout of the housing wall, a tongue-like movable retaining member is molded thereto, with the latter engaging in a rectangular cutout in the slider. Moreover, the invention relates to a tool for lifting the retaining member.

It is often desirable in the case of push button slide switches, to be able to take out the slider in order to replace either the movable contacts or the springs which are connected with the slider. Attempts, therefore, have always been made for designing a push button slide switch in such a way that the slider itself can be easily removed.

One type of push button slide switch comprising easily removable sliders, for example, is known from the German Petty Pat. No. 1,671,915. In order to replace the slider of this conventional type of push button slide switch, the limit stop web must be pulled out in this type of embodiment, vertically to the direction of slider movement. This, of course, is easily possible in cases where the switch is freely accessible from all sides. In its built-in condition, however, the switch is mostly only accessible from the front, so that it is impossible to replace parts which have to be removed vertically in relation to the direction of movement of the slider.

It has been tried, therefore, to design push button slide switches in such a way that the slider can be replaced from the front side. One such switch has become known from the German Pat. No. 1,233,456.

In this type of switch, a support member firmly retaining a U-shaped latch in its position, has to be pulled back which, in turn, engages with its legs in recesses provided for in the slider preventing the latter from being pulled out. Accordingly, for removing the slider, the support member has to be pulled back and, in the pulled back state of the support member, the U-shaped latch can be removed in the upward direction.

Another type of push button slide switch comprising a slider removable towards the front side, is known from the German Pat. No. 1,240,157. In this type of switch, for replacing the slider, a support member must likewise be pulled back in opposition to the action of a spring and, at the same time, a retaining member must be removed from an opening in the switch housing. In another type of embodiment of this conventional push button slide switch, subsequently to the pulling back of the support member, the slider must be pulled slantingly in the forward direction and tilted upwardly out of the push button housing.

In these conventional types of embodiments, of course, the slider can be removed towards the front side from the switch, but this requires the removal of individual switch parts, or else the slider cannot be pulled out of the housing straight forward, but only in a tilted position, thus increasing the space requirement for removing the slider.

Finally, from the German Pat. No. 1,260,586 there is known a push button slide switch, in which the slider is retained in the housing by a U-shaped latch. This latch, in turn, is retained in its position by a support member loaded by the reset spring. By pulling back the support member in opposition to the action of the spring, with the aid of a suitable tool, it is possible to pull the U-shaped latch in the upward direction out of the push button housing, and thereafter, to move the slider towards the front out of the switch housing.

This type of embodiment, however, requires so much space to be available, that the latch can be removed in the upward direction from the switch housing. This is mostly not the case when switches are built into a front panel.

It is an object of the present invention to provide a push button slide switch permitting the slider to be taken out of the housing on the front side without requiring parts of the switch to be removed and with the slider having to be tilted before permitting it to be removed. Moreover, it is an object of the invention to provide a simple tool for removing the slider from such types of push button slide switches.

SUMMARY OF THE INVENTION

With a view to a push button slide switch of the type mentioned hereinbefore, this object is achieved in that the retaining member is so designed that it can be lifted upwardly by means of a flat tool which is capable of being inserted either below or above the wall of the housing carrying the retaining member. In this way it becomes possible for the slider to be easily removed by insertion of a simple tool even in cases where the push button slide switch is mounted, in the usual way, in the front panel of an equipment, so that essentially only the slider with its actuating button projects out of the front panel. In so doing, it is not necessary to remove parts of the switch, and the slider can be pulled out straight forward, thus requiring no additional space for tilting the slider.

In a preferred embodiment, the retaining member comprises projections protruding out of the wall of the housing, wherein the projections are capable of being seized by the inserted tool, thus permitting the retaining member to be lifted. These projections are preferably arranged laterally on the retaining member and provided with slanting run-up surfaces in direction towards the front side. In this way the inserted flat tool can be easily pushed under the projections.

Another advantageous type of embodiment resides in that the retaining member is provided with a rearwardly directed projection capable of being engaged by the inserted tool. The retaining member itself may also be provided with a forwardly directed slanting run-up surface on the side facing the slider, and may thus be lifted by a tool inserted between the housing and the slider. The tool for lifting the retaining member for such a switch, consists of a flat part having a thickness of less than 1 millimeter, and a width not exceeding the spacing between the fixed contacts of the switch housing, and a length which is so dimensioned as to permit the retaining member to be easily seized by the inserted tool. Preferably, the tool is pointed on its side of introduction. Moreover, it is of advantage to provide the tool with an almost rectangular bend which is so designed as to prevent the slider from dropping out after the retaining member has been lifted.

For push button slide switches having larger actuating push buttons, the tool is provided with a double almost rectangular bend, in such a way as to grip around the actuating push button. Such a double bend is also of advantage insofar as the tool may be used as a lever for lifting the retaining member. Quite depending on the design of the retaining member, the tool at its actuating bend, is either of a fork-shaped design, or provided with a recess, or with a lateral cutout.

BRIEF DESCRIPTION OF THE DRAWING

Various types of embodiment of the invention will now be explained in greater detail with reference to FIGS. 1 to 9 of the accompanying drawing, in which.

DETAILED DESCRIPTION

Figure 1:
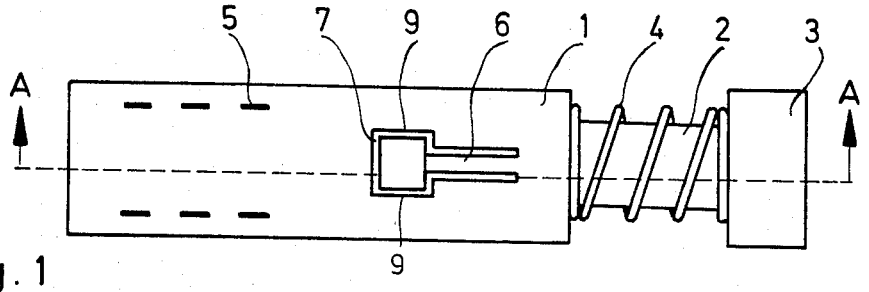
FIG. 1 is a top view onto a type of embodiment of the push button slide switch according to the invention.
Figure 8:
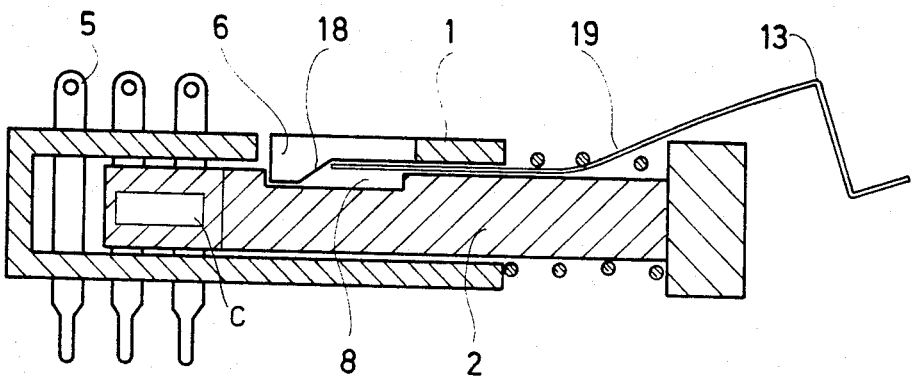
FIG. 8 is a section through the push button slide switch taken on line A-A of FIG. 7, as well as the side view of a tool to, be used for this push button slide switch; and, FIG. 9 is a top view onto the tool according to FIG. 8.
Figure 9:
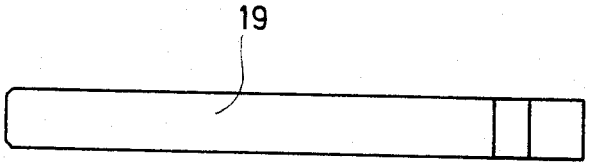

The push button slide switch as shown in FIG. 1 has a housing 1 of insulated material in which the slider 2 is disposed displaceably, which carries the actuating push button 3 at its end projecting out of the housing. Between the slider and the housing there is arranged the helical spring 4 which serves to return the slider to its starting position. Inside the housing 1 the fixed contacts 5 are arranged, which project on one or on both sides out of the housing. Slider 2 carries movable contacts C as illustrated in FIG. 8. The slider housing is provided on its top side with a cutout 7 which is engaged by a tongue-shaped movable retaining member 6 as molded to the slider housing. This retaining member projects through the cutout 7 into the housing of the push button slide switch, into a generally rectangular recess 8 of the slider, as is evident from FIG. 2. This serves to restrict the movement of the slider in both longitudinal directions, so that on one hand, the position between the fixed contacts 5 and the movable contacts C connected to the slider, is exactly determined in each position of the slider and, on the other hand, the slider is prevented from dropping out. According to the invention, this retaining member is embodied in such a way that it can be easily lifted by a simple tool inserted from the front side. In this way it is possible to remove the slider easily towards the front also in the built-in state of the switch, and without having to remove parts of the switch, in order thus to replace, for example, the movable contacts.

Figure 2:
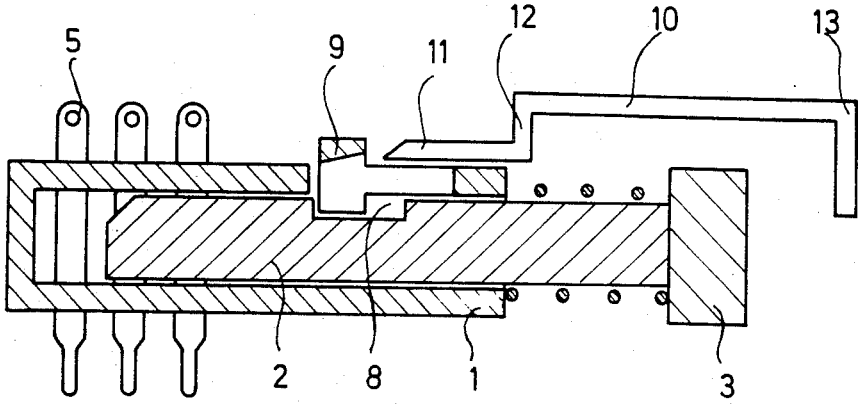
FIG. 2 is a section through the push button slide switch taken on line A—A of FIG. 1 and the side view of a suitable tool.

For this purpose, the retaining member in the type of embodiment as shown in FIGS. 1 and 2, is shown to be provided with lateral projections 9 each having a slanting run-up surface extending towards the front side, as is recognizable from FIG. 2.

Figure 3:
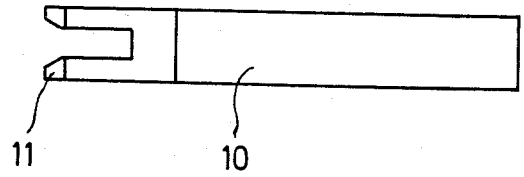
FIG. 3 is the top view of the tool shown in FIG. 2.

The retaining member is lifted with the aid of the flat tool 10 which, in FIG. 2, is shown in a side view and, in FIG. 3, in a top view. On the front side, the tool 10 is pointed at 11, and of a fork-like design enabling it to be pushed below the lateral projections 9 of the retaining member 6. The slanting run-up surfaces of the projections 9 permit an easy insertion of the tool below the projections, and, when push-in further, a lifting of the retaining member, so that the bottom side thereof is lifted out of the recess (cutout) 8 of the slider. Thus, the slider is permitted to be easily removed from the housing towards the front side. Upon reinsertion of the slider (into the housing), the tool is removed again, and the retaining member 6 will again project into the rectangular recess (cutout) 8 of the slider, thus preventing the latter again from dropping out.

When the tool is provided with a double rectangular bend 12, it may also be well inserted in cases where the push button 3 is larger than the housing 1 and, in addition thereto, it becomes possible to lift the retaining member 6 in a better way, because when pushing down the free end of the tool 10, the one edge of the bend 12 is applied to the housing, so that the retaining member can be easily lifted owing to the lever effect.

Preferably, tool 10 may further include a rectangular bend 13 which is so dimensioned as to prevent the slider from being completely pulled out of the housing. As is evident, the slider is acted upon by the pressure of the spring 2, and can easily be ejected out of the housing by the action of the spring when the retaining member is lifted. In order to prevent this, the bend 13 forms a limit stop for the slider.

Figure 4:
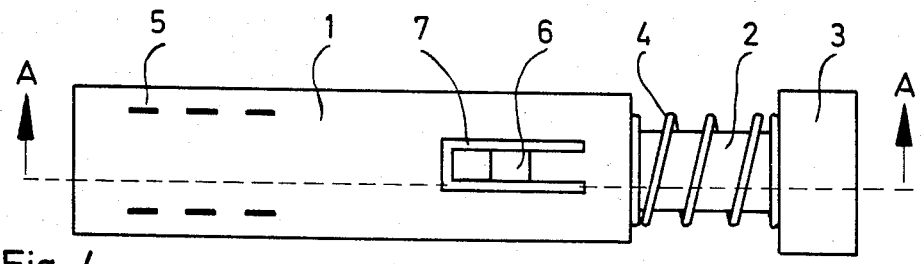
FIG. 4 is the top view onto another type of embodiment of the push button slide switch according to the invention.
Figure 5:
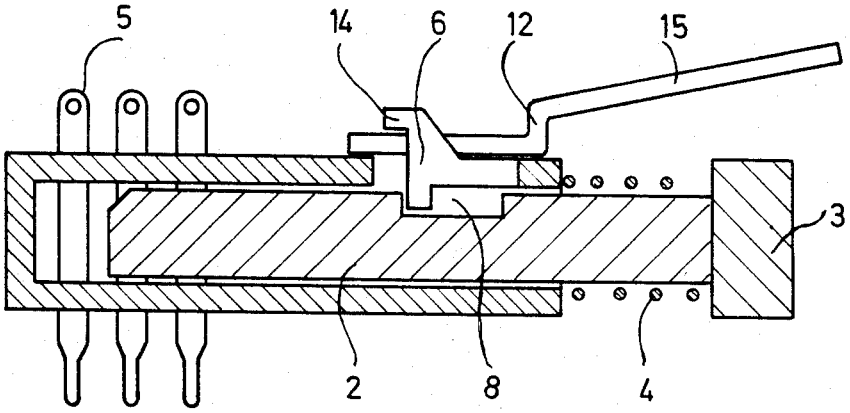
FIG. 5 is a section taken through the push button slide switch on line A—A of FIG. 4, as well as the side view of a suitable tool.

In the embodiment shown in FIGS. 4 and 5, the retaining member 6 is shown to be provided with a rearwardly extending projection 14 which likewise serves to lift the retaining member with the aid of a suitable tool.

The associated tool 15 is provided, for this purpose, on its front side with a cutout 16 which, upon insertion of the tool, is slipped over the retaining member 6 until the end of the tool can be pulled below the projection 14. With this tool, the double bend 12 is required to permit lifting of the retaining member with the aid of the projection 14 by pressing down the free end of the tool 15. This tool 15, of course, may also have a further bend in order to prevent the slider from slipping out.

Figure 6:
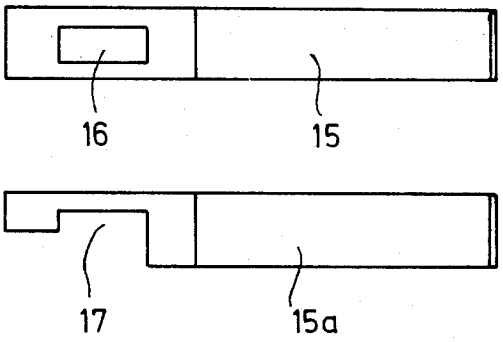
FIG. 6 is the top view onto two different types of embodiment of the tool according to FIG. 5.

Instead of the cutout 16, the tool 15 may also have a lateral cutaway portion 17 as is shown in the type of embodiment 15*a* in FIG. 6.

Figure 7:
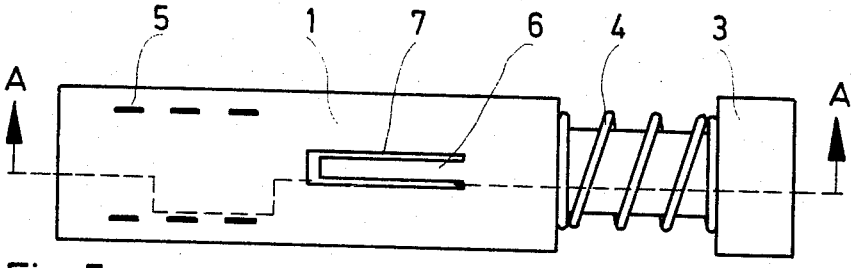
FIG. 7 is a top view onto a further type of embodiment of the push button slide switch according to the invention.

In the embodiment of the push button slide switch according to the invention as shown in FIGS. 7 and 8 the retaining member 6 is provided on its inside with a forwardly directed slanting run-up surface 18 so that it, upon insertion of a flat tool 19 between the housing 1 and the slider 2, can be lifted, thus permitting the slider to be removed from the housing towards the front side. The tool 19 again is shown to have a rectangular bend 13 which is aimed at preventing the slider from being thrown out (ejected) of the housing by the action of the spring 4 upon insertion of the tool into the housing, and upon lifting the retaining member.

As is clearly evident from the foregoing, in this manner it is easily possible to remove the slider of a built-in switch towards the front from the housing, without any other parts of the switch having to be removed prior thereto.

What is claimed is:

1. A push button slide switch in which fixed contacts are arranged in an elongated housing of insulated material, and in which a slider carrying movable contacts is longitudinally movably mounted, and in which a tongue-like movable retaining member is molded thereto in a cutout of the housing wall, with the retaining member engaging said slider in a generally rectangular cutout therein; wherein said fixed contacts are arranged in two transversely spaced and longitudinally extending rows along said housing with said fixed contacts extending through said housing in a direction substantially perpendicular to the longitudinal direction and projecting away from at least one side of said housing, wherein the transverse width of said retaining member is less than the transverse spacing between said rows of fixed contacts and said retaining member is provided with a longitudinally inwardly facing positive stop surface for limiting the outward translation of said slider by rigidly engaging a longitudinally outwardly facing wall portion of said generally rectangular cutout, wherein substantially all of the stop force components when said stop surface engages said wall portion are transmitted solely in the longitudinal direction thereby to retain said retaining member in said generally rectangular cutout, and wherein by the direct application of an external force to said retaining member in a direction substantially perpendicular to said longitudinal direction said retaining member is deflectable away from said rectangular cutout so that said positive stop surface can be deflected away from engagement with said wall portion to permit removal of said slider from said housing, and wherein the retaining member is provided with a tool engaging surface which is spaced-apart from the surface portion of said slider within said rectangular cutout and which generally faces said slider, said retaining member being arranged so that it can be lifted and deflected upwardly by means of a flat tool which is insertable with respect to said switch adjacent the wall of the housing carrying the retaining member for engaging said tool engaging surface.

2. A push button slide switch as claimed in claim 1, wherein the retaining member is provided with projections projecting over the wall of the housing.

3. A push button slide switch as claimed in claim 2, wherein the projections are arranged laterally on the retaining member, and provided with slanting run-up surfaces extending towards the front side.

4. A push button slide switch as claimed in claim 1, wherein the retaining member is provided on its tool engaging surface with a slanting run-up surface directed towards the front side.

5. A push button slide switch in which fixed contacts are arranged in an elongated housing of insulated material, and in which a slider carrying movable contacts is longitudinally movably mounted, and in which a tongue-like movable retaining member is molded thereto in a cutout of the housing wall, with the retaining member engaging said slider in a generally rectangular cutout therein, wherein said fixed contacts are arranged in two transversely spaced and longitudinally extending rows along said housing with said fixed contacts extending through said housing in a direction substantially perpendicular to the longitudinal direction and projecting away from at least one side of said housing, wherein the transverse width of said retaining member is less than the transverse spacing between said rows of fixed contacts and said retaining member is provided with a longitudinally inwardly facing positive stop surface for limiting the outward translation of said slider by rigidly engaging a longitudinally outwardly facing wall portion of said generally rectangular cutout, and wherein by the direct application of an external force thereto said retaining member is deflectable away from said rectangular cutout so that said positive stop surface can be deflected away from engagement with said wall portion to permit removal of said slider from said housing, and wherein the retaining member is provided with a slanted surface which is spaced-apart from the surface portion of said slider within said rectangular cutout and which generally faces said slider, said retaining member being arranged so that it can be lifted and deflected upwardly by means insertable with respect to said switch housing adjacent the wall of the housing carrying the retaining member and between said rows of fixed contacts for engaging said slanted surface.

* * * * *